US008508199B2

(12) United States Patent
Arigliano et al.

(10) Patent No.: US 8,508,199 B2
(45) Date of Patent: Aug. 13, 2013

(54) CURRENT LIMITATION FOR LDO

(75) Inventors: Antonello Arigliano, Kaugering (DE); Eric Marshalkowski, Inning (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 317 days.

(21) Appl. No.: 13/066,604

(22) Filed: Apr. 19, 2011

(65) Prior Publication Data

US 2012/0262137 A1 Oct. 18, 2012

(30) Foreign Application Priority Data

Apr. 13, 2011 (EP) ..... 11368013

(51) Int. Cl.
*G05F 1/573* (2006.01)

(52) U.S. Cl.
USPC ..... 323/277; 323/274

(58) Field of Classification Search
USPC ..... 323/273, 274, 275, 276, 277, 279, 323/315, 316, 908; 361/93.9
See application file for complete search history.

(56) References Cited

U.S. PATENT DOCUMENTS

| | | | | |
|---|---|---|---|---|
| 4,851,953 | A | 7/1989 | O'Neill et al. | |
| 5,929,617 | A | 7/1999 | Brokaw | |
| 6,246,221 | B1 | 6/2001 | Xi | |
| 6,518,737 | B1 | 2/2003 | Stanescu et al. | |
| 6,573,693 | B2 * | 6/2003 | Okamoto | 323/273 |
| 6,690,147 | B2 * | 2/2004 | Bonto | 323/280 |
| 6,703,813 | B1 | 3/2004 | Vladislav et al. | |
| 7,405,546 | B2 | 7/2008 | Amrani et al. | |
| 7,615,977 | B2 * | 11/2009 | Gicquel et al. | 323/273 |
| 7,710,090 | B1 * | 5/2010 | Kimura | 323/276 |
| 7,944,663 | B2 * | 5/2011 | Morino | 361/93.1 |
| 8,174,251 | B2 * | 5/2012 | Kimura | 323/273 |
| 2009/0309559 | A1 | 12/2009 | Xia et al. | |

FOREIGN PATENT DOCUMENTS

WO WO 2011/006979 1/2011

OTHER PUBLICATIONS

European Search Report 11368013.3-2206 Mail Date—Oct. 30, 2012, Dialog Semiconductor.

"Low Dropout Voltage Regulator with High Stability Output Current Limit Circuit," by Gary Pace, et al., IP.Com Journal, Ip.Com Inc., Jul. 16, 2002, West Henrietta, NY, US, Jul. 16, 2002, 4 pgs., XP013003822.

* cited by examiner

*Primary Examiner* — Gary L Laxton
(74) *Attorney, Agent, or Firm* — Saile Ackerman LLC; Stephen B. Ackerman

(57) ABSTRACT

A method and circuits to limit the output load current of a current driven LDO voltage regulator are disclosed. The current through a second pass transistor, being in parallel to a first pass transistor and being a fraction of the current through the first pass transistor is measured and compared with a reference current. In case the current through the second pass transistor is larger than this reference current the current through the gates of both pass devices is reduced and thus the output load current of the voltage regulator is limited.

14 Claims, 2 Drawing Sheets

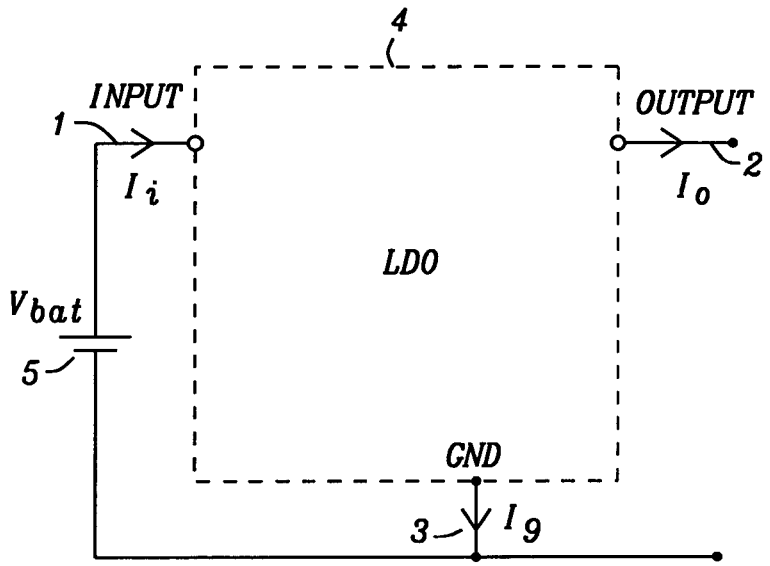
FIG. 1 – Prior Art
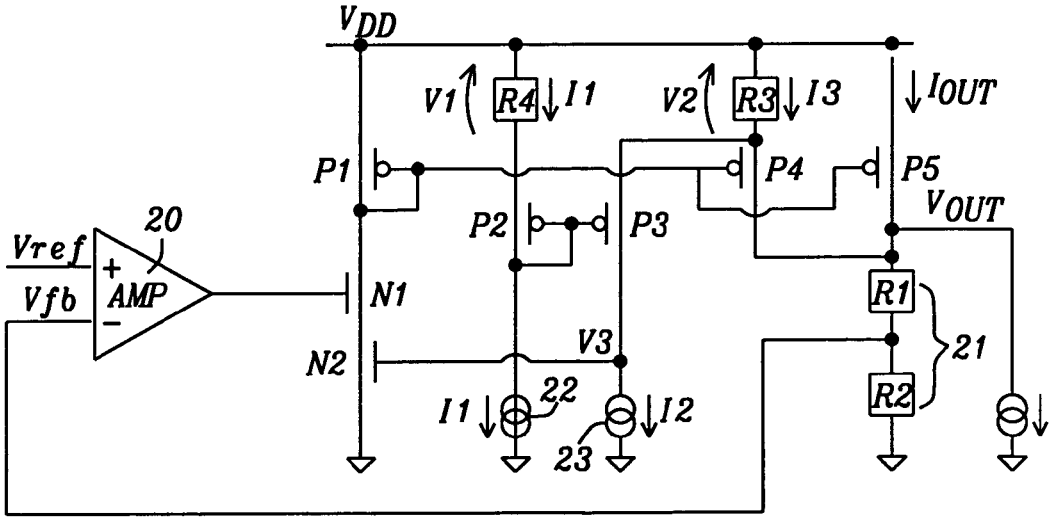
FIG. 2

CURRENT LIMITATION FOR LDO

BACKGROUND OF THE INVENTION (1) Field of the Invention

This invention relates generally to voltage regulators, and more particularly to low dropout (LDO) having a clipping of the output current.

(2) Description of the Prior Art

Low-dropout (LDO) linear regulators are commonly used to provide power to low-voltage digital and analog circuits, where point-of-load and line regulation is important. FIG. 1 prior art shows a typical basic circuit of a LDO regulator 4 having an input voltage $V_i$ 1, an output voltage $V_o$ 2, an input current $I_i$ and an output current $I_o$.

In order to prevent high current stress of the LDO's pass device, especially during start-up, it is important to limit the output current.

There are various patents disclosed to limit the output current of an LDO or correspondingly to limit the drive current of a pass device of an LDO:

U.S. Pat. No. 5,929,617 (to Brokaw) teaches an low dropout voltage regulator (LDO) drive reduction circuit detecting when the LDO's output voltage is going out of regulation due to a falling input voltage while the output is lightly loaded, and reduces the drive to the pass transistor in response. This action prevents the LDO's ground current from rising unnecessarily. The drive reduction circuitry directly monitors the voltage across the pass transistor; when above a predetermined threshold voltage which is typically well-below the LDO's specified dropout voltage, the pass transistor drive is permitted to vary as necessary to maintain a specified output voltage. If the monitored voltage falls below the threshold voltage, indicating that the input voltage is falling and the output is lightly loaded, the drive reduction circuit reduces the drive current, which would otherwise get increased in an attempt to restore the output voltage. The transconductance of the novel drive reduction circuit is relatively high, making the region over which the drive reduction circuit is active small and permitting the threshold voltage to be precisely set.

U.S. Pat. No. 6,518,737 (to Stanescu et al.) discloses a low dropout voltage regulator with non-Miller frequency compensation. The LDO circuit has two wide-band, low-power cascaded operational transconductance amplifiers (OTAs): an error amplifier and a unity-gain-configured voltage follower. The unity-gain-configured voltage follower drives a gate of a power PMOS path transistor with a high parasitic gate capacitance. The wide-band, low-power OTAs enable the use of a single, low-value load capacitor with a low equivalent series resistance (ESR). A frequency compensation capacitor is connected in parallel with the upper resistor of a feedback network, which introduces a zero-pole pair that enhances the phase margin close to unity-loop-gain frequency.

U.S. Pat. No. 6,703,813 (to Vladislav et al.) discloses an LDO regulator being arranged to provide regulation with a pass device, a cascode device, a level shifter, an error amplifier, and a tracking voltage divider. The error amplifier is arranged to sense the output voltage and provide an error signal to the pass device via the level shifter. The level shifter changes the DC level of the error signal such that the pass device is isolated from damaging voltages. The cascode device is arranged to increase the impedance between the output node and the pass transistor such that the LDO regulator can sustain input voltages that exceed process limits without damage. The cascode device is biased by the tracking voltage divider. The tracking voltage divider adjusts the biasing to the cascode device such that a decreased input voltages result in lower impedance, and increased input voltages result in higher impedance.

SUMMARY OF THE INVENTION

A principal object of the present invention is to limit the output load current of a current driven LDO.

A further object of the present invention is to limit high current stress of the LDO's pass device especially during start-up.

A further object of the present invention is achieving a precise current limitation.

Moreover an object of the invention is to use part of the pass devices to measure the output current.

In accordance with the object of this invention a circuit to limit the output load current of a current driven LDO voltage regulator, wherein said LDO voltage regulator comprises at least an error amplifier, a first pass transistor, a means to control said pass transistor using the output of said error amplifier and a feedback mechanism to feed a measure of the output voltage back to said error amplifier has been achieved. The circuit invented also comprises a second PMOS pass transistor, wherein its drain is connected to the drain of said first pass transistor, its gate is connected to the gate of said first pass transistor and to the gate of a first PMOS transistor in a diode configuration, and its source is connected to a first means providing resistance and to the source of a second PMOS transistor, said first means providing resistance, wherein its first terminal is connected to VDD voltage and a second terminal is connected to the source of said second PMOS pass transistor, and said first PMOS transistor in a diode configuration, wherein its source is connected to $V_{DD}$ voltage and its drain is connected to its gate and to a first terminal of said means to control said first pass transistor. Furthermore the circuit invented comprises said second PMOS transistor in a diode configuration, wherein its gate is connected to its drain and to the gate of a third PMOS transistor, its source is connected to a second terminal of a second means providing resistance, and its drain is connected to a first terminal of a first current source, said first current source wherein its second terminal is connected to $V_{SS}$ voltage, and said third PMOS transistor wherein its source is connected to the source of said second pass transistor and its drain is connected to a first terminal of a second current source and to a gate of a first NMOS transistor. Finally the circuit comprises said first NMOS transistor, wherein its source is connected to VSS voltage and its drain is connected to a second terminal of said means to control said first pass transistor, said second means providing resistance, wherein its first terminal is connected to VDD voltage, and said second current source wherein its second terminal is connected to $V_{SS}$ voltage.

In accordance with the objects of the invention a method to limit the output load current of a current driven LDO voltage regulator has been achieved. The method invented comprises, first, (1) to provide a current driven LDO voltage regulator structure, an additional second pass transistor, wherein the second pass transistor is smaller than a first pass transistor by a factor K1, a first and a second current source, wherein the first current source generates a current I1 and the second current source generates a current I2, a first resistor and a second resistor, wherein the first resistor is smaller than the second resistor by a factor K2, a current mirror and a first and a second transistor. The following steps of the method are (2) to measure the current through the second pass transistor which is linearly correlated to the output current of the LDO regulator, (3) a check, if current measured in previous step is smaller than a reference current, and, if so, go to step (2) otherwise go to step (4), and (4) limit the current controlling the gate voltage of the two parallel pass transistors.

BRIEF DESCRIPTION OF THE DRAWINGS

In the accompanying drawings forming a material part of this description, there is shown:

FIG. 1 prior art illustrates the principal currents of an LDO.

FIG. 2 shows a schematic of an LDO and a circuitry limiting the output current

DESCRIPTION OF THE PREFERRED EMBODIMENTS

Figure 3:
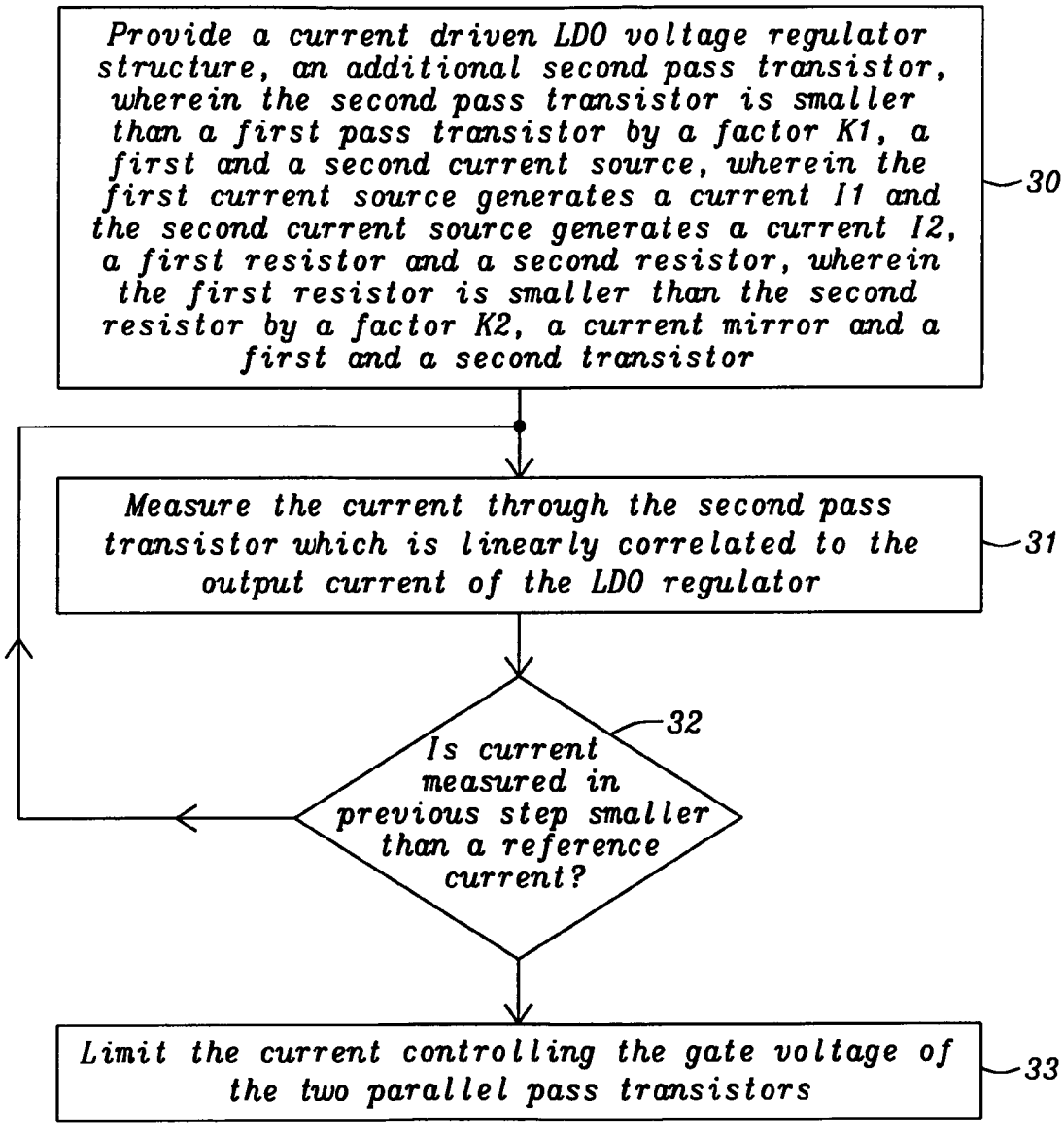
FIG. 3 shows a flowchart of a method to limit the output current of a current driven LDO voltage regulator.

The preferred embodiments disclose circuits and a method to limit the output current in a standard LDO structure. The present invention prevents high current stress of the LDO's pass device, especially during start-up.

FIG. 2 shows a standard LDO structure with a preferred embodiment of the circuitry of the present invention.

The LDO shown comprises an error amplifier 20 having as inputs a reference voltage $V_{REF}$ and the feedback voltage $V_{FB}$ from the voltage divider 21, comprising resistors $R_1$ and $R_2$. $V_{OUT}$ is the output voltage of the LDO. In the preferred embodiment $R_1$ matches $R_2$; the voltage divider 21 is used to provide a feedback voltage, representing the output voltage $V_{OUT}$, to the error amplifier 20 in order to set the output voltage $V_{OUT}$ to a specified voltage.

Transistors P1, P2, P3, P4, and P5 are PMOS transistors. Transistors P1 and P2 are used in a diode configuration. Transistor P4 has been added in parallel to pass device P5 in order to form a pass device together, wherein P4 is also used to measure the current $I_3$. Transistor P4 matches transistor P5, this means P4 has the same device characteristics as P5, but transistor P4 has a smaller size than P5. Transistor P4 is K1-times smaller than P5. Transistor P2 matches Transistor P3 and in the preferred embodiment has the same size.

The current source 22 generates current $I_1$; the current source 23 generates current $I_2$. In the preferred embodiment the current $I_1$ equals $I_2$.

Measuring the current I3 through transistor P4 enables the limitation of the output current of the LDO Iout. The current $I_3$ is K1-times smaller as the output current $I_{OUT}$ through the pass device P5:

$$IOUT=K1\times I_3.$$

The current through the voltage divider can be neglected when the current limit retroaction is active.

The means of resistance R3 matches means of resistance R4. R3 and R4 could be implemented as resistors or transistors. Both resistors R3 and R4 are used to compare current $I_1$ with current $I_3$. Resistor R1 matches R2 and both are used to set the LDO output voltage to a specified value. The control of the limitation of the output current $I_{OUT}$ of the LDO is performed at first by measuring the current $I_3$ through transistor P4, wherein, as mentioned above, the current I3 is K1-times smaller than the current $I_{OUT}$ through transistor P5. The measurement of current $I_3$ is done by regulating the gate voltage of N2 according to the difference between $I_3$ and $I_1$. The current through transistor P1 is mirrored to both pass transistors P4 and P5. Thus the output current $I_{OUT}$ is controlled.

Transistors P2 and P3 work as a current comparator in regard of currents I1 and I2. Considering the preferred embodiment, where P3=P2 and I1=I2, current I1 is actually compared with current I3/K2, where K2 is the factor R4/R3, by comparing the voltage drop V1 and V2. It is equivalent to a same circuit where the sources of P3 and P2 are connected only to VDD and the current source 23 has a current I2=I3/K2.

The current $I_3$ through transistor P4 can increase as long as current $I_3<K2\times I_1$, wherein K2=R4/R3. If $I_3<K2\times I_1$ then voltage V2 is smaller than voltage V1, and consequently voltage V3 increases. Since voltage V3 is regulating the gate of NMOS transistor N2, current I3 can increase and a higher output current can be generated, if required.

The current $I_3$ through transistor P4 is forced to decrease as long as current $I_3>K2\times I_1$. If $I_3>K2\times I_1$ then voltage V2 is larger than voltage V1, and consequently voltage V3 decreases, thus decreasing the current through PMOS transistor N2.

Using the regulation loop as described above the output current through pass transistor P5 will be limited to $I_{OUT}=I_1\times K1\times K2$.

FIG. 3 shows a flowchart of the method of the present invention to limit the output load current of a current driven LDO voltage regulator. The first step 30 describes the provision a current driven LDO voltage regulator structure, an additional second pass transistor, wherein the second pass transistor is smaller than a first pass transistor by a factor K1, a first and a second current source, wherein the first current source generates a current I1 and the second current source generates a current I2, a first resistor and a second resistor, wherein the first resistor is smaller than the second resistor by a factor K2, a current mirror and a first and a second transistor. Step 31 describes the measurement of the current through the second pass transistor, which is flowing through said first resistor and which is linearly correlated to the output current of the LDO regulator. Step 32 comprises a check if the current measured in the previous step is smaller than a reference current. As described above, this reference current is $I_{1*K2}$. In case the current through the second pass transistor measured is smaller than the reference current, the process flow is going back to step 31 otherwise the process flow goes to step 33 illustrating limiting the current controlling the gate voltage of the two parallel pass transistors.

While the invention has been particularly shown and described with reference to the preferred embodiments thereof, it will be understood by those skilled in the art that various changes in form and details may be made without departing from the spirit and scope of the invention.

What is claimed is:

1. A circuit to limit the output load current of a current driven LDO voltage regulator, wherein said LDO voltage regulator comprises at least an error amplifier, a first pass transistor, a means to control said pass transistor using the output of said error amplifier and a feedback mechanism to feed a measure of the output voltage back to said error amplifier, is comprising:

a second PMOS pass transistor, wherein its drain is connected to the drain of said first pass transistor, its gate is connected to the gate of said first pass transistor and to the gate of a first PMOS transistor in a diode configuration, and its source is connected to a first means providing resistance and to the source of a second PMOS transistor;

said first means providing resistance, wherein its first terminal is connected to VDD voltage and a second terminal is connected to the source of said second PMOS pass transistor;

said first PMOS transistor in a diode configuration, wherein its source is connected to $V_{DD}$ voltage and its drain is connected to its gate and to a first terminal of said means to control said first pass transistor;

said second PMOS transistor in a diode configuration, wherein its gate is connected to its drain and to the gate of a third PMOS transistor, its source is connected to a second terminal of a second means providing resistance, and its drain is connected to a first terminal of a first current source;

said first current source wherein its second terminal is connected to $V_{SS}$ voltage;

said third PMOS transistor wherein its source is connected to the source of said second pass transistor and its drain is connected to a first terminal of a second current source and to a gate of a first NMOS transistor;

said first NMOS transistor, wherein its source is connected to VSS voltage and its drain is connected to a second terminal of said means to control said first pass transistor;

said second means providing resistance, wherein its first terminal is connected to VDD voltage; and said second current source wherein its second terminal is connected to $V_{SS}$ voltage.

2. The circuit of claim 1 wherein said means to control said first pass transistor is an NMOS transistor.

3. The circuit of claim 1 wherein said first means to provide resistance is a resistor.

4. The circuit of claim 1 wherein said first means to provide resistance is a transistor.

5. The circuit of claim 1 wherein said second means to provide resistance is a resistor.

6. The circuit of claim 1 wherein said second means to provide resistance is a transistor.

7. The circuit of claim 1 wherein said first means to provide resistance is smaller in resistance than said second means to provide resistance.

8. The circuit of claim 1 wherein said circuit to limit the output load current of a current driven LDO voltage regulator is integrated on a chip.

9. The circuit of claim 1 wherein said second pass transistor is smaller in size than said first pass transistor.

10. A method to limit the output load current of a current driven LDO voltage regulator is comprising:

(1) providing a current driven LDO voltage regulator structure, an additional second pass transistor, wherein the second pass transistor is smaller than a first pass transistor by a factor K1, a first and a second current source, wherein the first current source generates a current I1 and the second current source generates a current I2, a first resistor and a second resistor, wherein the first resistor is smaller than the second resistor by a factor K2, a current mirror and a first and a second transistor;

(2) measuring the current through the second pass transistor, which is flowing through said first resistor and which is linearly correlated to the output current of the LDO regulator;

(3) if current measured in previous step is smaller than a reference current go to step (2) otherwise go to step (4); and (4) limit the current controlling the gate voltage of the two parallel pass transistors.

11. The method of claim 10 wherein said output load current is limited by regulating the gate voltage of said pass transistors by a voltage which increases if the current through said second pass transistor is larger than the reference current.

12. The method of claim 11 wherein said gate voltage is increased by said current mirror if the current through said second pass transistor is larger than the reference current.

13. The method of claim 12 wherein said current mirror is a PMOS current mirror.

14. The method of claim 12 wherein the output current Iout will be limited to $Iout = I1 \times K1 \times K2$.

* * * * *

UNITED STATES PATENT AND TRADEMARK OFFICE

CERTIFICATE OF CORRECTION

PATENT NO. : 8,508,199 B2
APPLICATION NO. : 13/066604
DATED : August 13, 2013
INVENTOR(S) : Antonello Arigliano et al.

It is certified that error appears in the above-identified patent and that said Letters Patent is hereby corrected as shown below:

On the Title Page

In the Inventors (75), delete first Inventor "Antonello Arigliano, Kaugering (DE)" and replace with -- Antonello Arigliano, Kaufering (DE) --.

In the Inventors (75), delete second Inventor "Eric Marshalkowski, Inning (DE)" and replace with -- Eric Marschalkowski, Inning (DE) --.

Signed and Sealed this
Twelfth Day of November, 2013

Teresa Stanek Rea
*Deputy Director of the United States Patent and Trademark Office*